US006427868B1

(12) United States Patent
Vine

(10) Patent No.: US 6,427,868 B1
(45) Date of Patent: Aug. 6, 2002

(54) DISPENSER FOR DISPOSABLE CUPS

(76) Inventor: Menacham Vine, 8 Basht Street, Telz Stone, D.N. Harei Yehuda 90838 (IL)

( * ) Notice: Subject to any disclaimer, the term of this patent is extended or adjusted under 35 U.S.C. 154(b) by 0 days.

(21) Appl. No.: 09/615,224

(22) Filed: Jul. 13, 2000

(30) Foreign Application Priority Data

Jul. 23, 1999 (IL) ..... 131068

(51) Int. Cl.[7] ..... A47F 1/04
(52) U.S. Cl. ..... 221/307; 221/308; 221/310
(58) Field of Search ..... 221/303, 307, 221/308, 310

(56) References Cited

U.S. PATENT DOCUMENTS 3,315,842 A * 4/1967 McGurk
3,435,988 A * 4/1969 Jonas et al.
5,427,273 A * 6/1995 Vine ..... 221/221
5,884,803 A * 3/1999 Vine ..... 221/44
5,941,415 A * 8/1999 Roethel ..... 221/310

* cited by examiner

*Primary Examiner*—David H. Bollinger
(74) *Attorney, Agent, or Firm*—Wood, Phillips, Katz, Clark & Mortimer

(57) ABSTRACT

The invention provides a cup dispenser for sequentially dispensing individual, disposable, rimmed cups having diameters varying from each other by several centimeters, from a stacked column thereof, comprising a cup-retaining and dispensing body provided with a tubular opening having a lower edge and with retaining means consisting essentially of at least two opposed flexible tongue-like members descending from the inner wall thereof, each of the members being subdivided into two portions, a first portion of the first member, in conjunction with the opposed first portion of the second member underriding and supporting the rim of a lowermost cup of the stacked column placed therein, and a second portion of the first member, in conjunction with the opposed second portion of the second member, simultaneously overriding the rim of the lowermost cup, and underriding and supporting the rim of the next to lowermost cup in the stack, whereby the pair of first portions retain the lowermost cup until the removal thereof from the dispenser, while the pair of second portions of the opposed flexible tongue-like members support and retain the next to lowermost cup during the removal of the lowermost cup from the dispenser.

14 Claims, 2 Drawing Sheets

DISPENSER FOR DISPOSABLE CUPS

The present invention relates to the dispensing of disposable cups. More particularly, the invention provides a dispenser for rimmed, stacked disposable cups, such dispenser being able to handle cups having size variation, between one stack and the next, of over 2:1.

In US Pat. Nos. 5,427,273 and 5,884,803 the present applicant has disclosed dispensers for disposable cups. They hold tapered deformable cups in a stacked column, the lowest cup of the stack being exposed so that it can be gripped by hand and removed when required for use. Such dispensers save manpower, protect the cups against dirt and dispersal, and provide convenient means for ensuring that people using a water cooler or consuming beer or soft drinks have available as many fresh cups as needed.

The above patents describe dispensers having two or three wedge-like protrusions engaging the lowest cup, said protrusions being rigidly attached to the inner wall of the dispenser body. Dispensers made according to the above specifications have been found to operate very satisfactorily when handling disposable cups of diameters within their range, such cups typically having having a rim diameter of between about 6.4 and 7.4 cm.

There, however, exists both smaller cups and larger cups which are also in widespread use. A typical small cup has an outside diameter of about 4.5 cm. and prior art dispensers able to carry cups of a rim diameter of about 6.4–7.4 cm. are totally incapable of handling such small cups.

Bottled water companies throughout the world would be very much interested in having a dispenser suitable for all size cups which would enable them to offer their customers a single dispenser capable of dispensing cups of various rim sizes, whether said cups be flat or cone shaped and made of plastic or paper, without having to change the cup dispenser.

It is of course possible to redesign a prior-art dispenser to handle smallerr cups, but such dispenser would then not be able to handle the larger cups. Thus users wishing to dispense both sizes would need two different dispensers.

It is therefore one of the objects of the present invention to obviate the disadvantages of prior art cup dispensers and to provide a dispenser capable of handling a wide size range without requiring the user to make any adjustments. It is a further object of the present invention to provide a dispenser which can handle cups of various capacities and rim sizes.

The present invention achieves the above objects by providing a cup dispenser for sequentially dispensing individual, disposable, rimmed cups having diameters varying from each other by several centimeters, from a stacked column thereof, comprising a cup-retaining and dispensing body provided with a tubular opening having a lower edge and with retaining means consisting essentially of at least two opposed flexible tongue-like members descending from the inner wall thereof, each of said members being subdivided into two portions, a first portion of said first member, in conjunction with the opposed first portion of said second member underriding and supporting the rim of a lowermost cup of said stacked column placed therein, and a second portion of said first member, in conjunction with the opposed second portion of said second member, simultaneously overriding the rim of said lowermost cup, and underriding and supporting the rim of the next to lowermost cup in said stack, whereby said pair of first portions retain said lowermost cup until the removal thereof from said dispenser, while said pair of second portions of said opposed flexible tongue-like members support and retain the next to lowermost cup during the removal of said lowermost cup from said dispenser.

In a preferred embodiment of the present invention there is provided a cup dispenser wherein said opposed flexible tongue-like members converge towards each other in the direction of said lower edge.

In a most preferred embodiment of the present invention there is provided a dispenser wherein each of said portions is provided with an inwardly-directed lip. In preferred embodiments of the present invention said retaining means consist essentially of two opposed flexible tongue-like members, wherein said members are substantially diametrically opposed within said opening.

In a variation of said embodiment said retaining means consist essentially of two opposed flexible tongue-like members, wherein a major part of both of said members are positioned within the same imaginary semi-annular co-planar segment of said opening.

Yet further characteristics of preferred forms will become apparent from the description.

It will thus be realized that the novel device of the present invention can dispense both large and small cups due to the flexibility of the tongue-like members. No special mechanism is required for this purpose, as the dispenser is manufactured as a unitary plastic molding.

The present application details only the main body of the dispenser. It is to be understood that a complete unit is further equipped with an attached tubular cup container which holds the cup stack and prevents the entry of dirt. Also, means are usually provided for convenient attachment of the dispenser to a vertical surface, such as a wall or a side of a water cooler. These items are included although not referred to in the present text.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
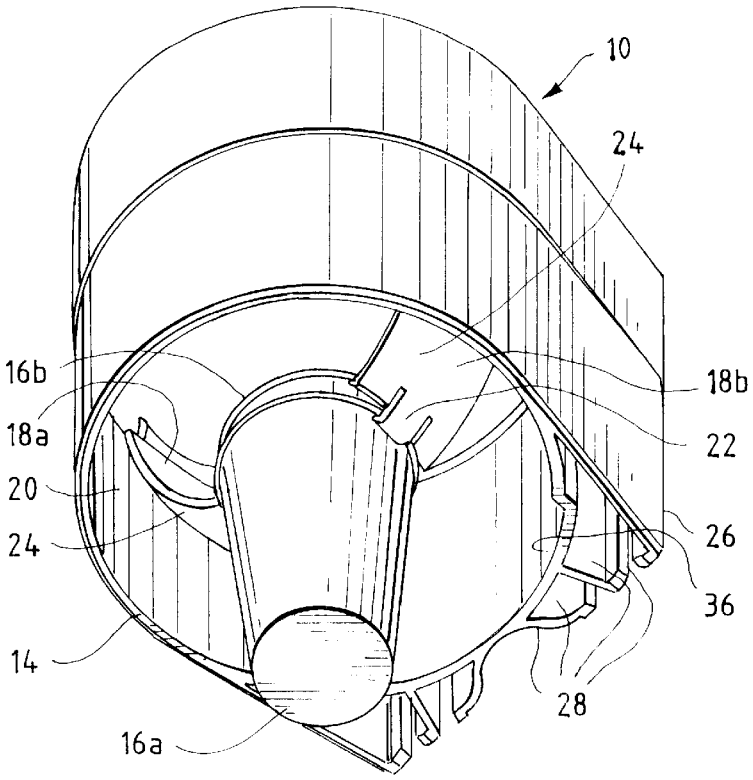
FIG. 1 is a perspective view of a preferred embodiment of the dispenser according to the invention, shown holding 2 cups.

There is seen in FIG. 1 a cup dispenser for sequentially dispensing individual disposable rimmed cups from a stacked column thereof.

A cup-retaining and dispensing body 10 shown can be suitably molded from a thermoplastic resin. A plastic which has been found to be particularly suitable is ABS, with a rubber additive.

Figure 3:
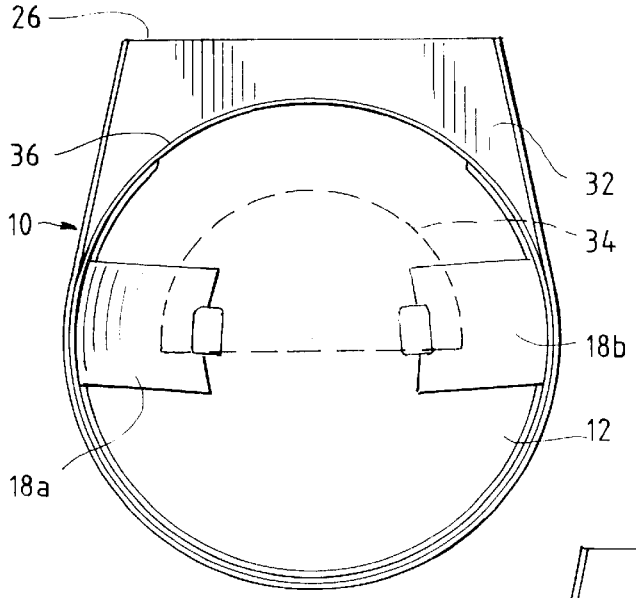
FIG. 3 is a plan view showing the upper face of the dispenser.

The body 10 is provided with an upper annular opening 12, seen in FIG. 3, and a lower edge 14. Retaining means for the cups 16*a,* 16*b* consist essentially of two opposed flexible tongue-like members 18*a,* 18*b* which descend from the inner wall 20 between the upper opening 12 and lower edge 14.

The members 18*a,* 18*b* are flexible between positions enabling the engagement and dispensing of cups having various rim diameters with a range difference of between about 2.5 and 3 cm. For example, the present embodiment is suitable for cups having rim diameters of between 4.5 and 7.6 cm. It should be realized that this embodiment can also be modified using the same design to take cups in a different range, e.g., from 6.5–8.5 cm.

Each member 18*a,* 18*b* is subdivided at its lower end into two portions 22, 24. A first portion 22 of first member 18*a,* in conjunction with the opposed first portion 22 of second member 18*b,* underrides and supports the rim of a lowermost cup 16*a*. A second portion 24 of first member 18*a,* in conjunction with the opposed second portion 24 of second member 18*b,* simultaneously overriding the rim of lowermost cup 16*a,* and underrides and supports the rim of the next to lowermost cup 16*b* in a stack (not shown). Thereby the pair of first portions 22 retain the lowermost cup 16*b* until the removal thereof from the dispenser, while the pair of second portions 24 of the opposed flexible tongue-like members 18*a,* 18*b* support and retain the next to lowermost cup 16*a* during the removal of the lowermost cup 16*a* from the dispenser.

The rear face 26 of the body 10 is flat for convenience of attachment to a vertical surface. The complex hollows 28 shown connected to the rear face 26 serve to enable said body to be affixed to various brackets.

Figure 3A:
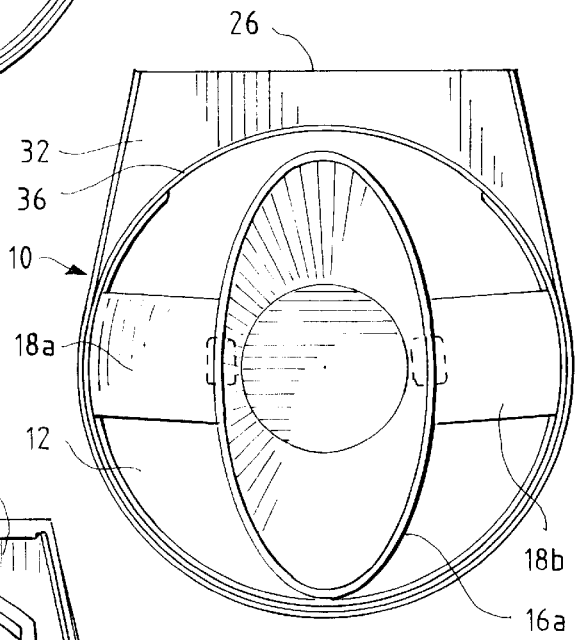
FIG. 3A is a plan view showing the upper face of the dispenser with a cup of large diameter being distorted during removal thereof.

A relief portion 36 at the rear of the opening 12 serves to allow distortion of a large diameter lowermost cup 16*a,* when necessary, as shown in FIG. 3A, when gripped by a user for the purpose of removal.

With reference to the rest of the figures, similar reference numerals have been used to identify similar parts.

Figure 2:
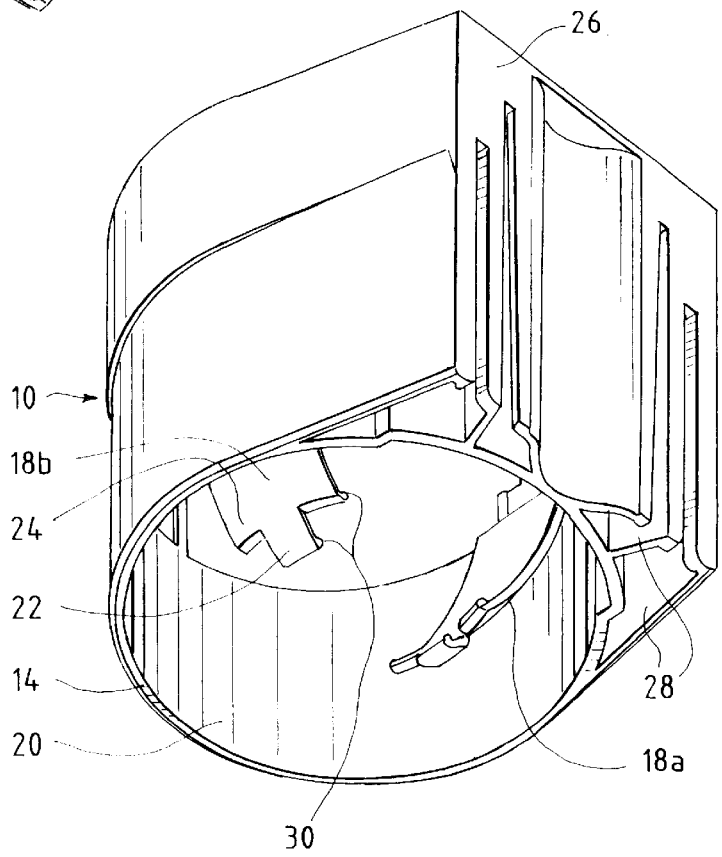
FIG. 2 is a perspective view of an empty dispenser.

Referring now to FIG. 2, there is seen the same embodiment 10 as in FIG. 1. The body 10 is shown upside down in order to reveal constructional details.

As seen in the diagram, opposed flexible tongue-like members 18*a,* 18*b* converge towards each other in the direction of the lower edge 14.

Advantageously each portion 22, 24 is provided with an inwardly-directed lip 30 which engages the cup rim.

The first portion 22 is preferably of narrower width than the second portion 24 and extends from a central area of the second portion 24.

FIGS. 3 and 3A illustrate the upper face 32 of the dispenser body 10. The complex hollows 28 are hidden when viewing the body 10 from above, for improved appearance.

For ease of removal of the lowermost cup 16*a,* seen in FIG. 3A, a major part of both members 18*a,* 18*b* are positioned within the same imaginary semi-annular co-planar segment 34 of the upper opening 12.

The relief portion 36 at the rear of the opening 12 serves to allow distortion of a large diameter lowermost cup 16*a,* when necessary, as shown in FIG. 3A, when gripped by a user for the purpose of removal.

Figure 4:
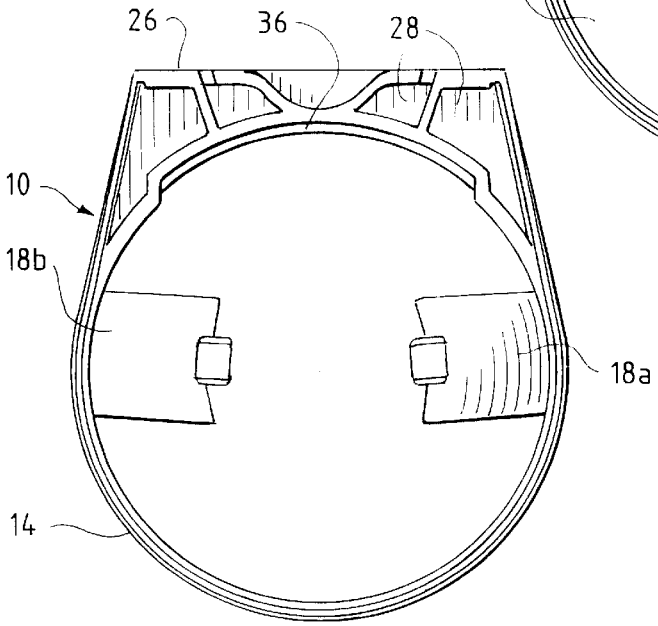
FIG. 4 is a view of the lower face of the dispenser.

Seen in FIG. 4 is the lower edge 14 of the dispenser body 10.

The diagram shows the members 18*a,* 18*b* being positioned substantially diametrically opposed within the opening 12.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cup dispenser for sequentially dispensing individual, disposable, rimmed cups having diameters varying from each other by several centimeters, from a stacked column thereof, comprising a cup-retaining and dispensing body provided with a tubular opening having a lower edge and with retaining means consisting essentially of at least two flexible flange members descending from an inner wall of said dispensing body, a first member of said members being subdivided into two portions and a second member of said members being subdivided into two portions wherein a first portion of each of said of narrower width than a second portion of each of said members and extends from a central area of said second portion, said first portion of said first member, in conjunction with the opposed first portion of said second member, underlying and supporting the rim of a lowermost cup of said stacked column placed therein, and a second portion of said first member, in conjunction with the opposed second portion of said second member, simultaneously overriding the rim of said lowermost cup, and underriding and supporting the rim of the next to lowermost cup in said stacked column, whereby said pairs of first portions retain said lowermost cup until the removal thereof from said dispenser, while said pair of second portions of said opposed flexible flange members support and retain the next to lowermost cup during the removal of said lowermost cup from said dispenser.

2. A cup dispenser according to claim 1, wherein said opposed flexible flange members converge towards each other in the direction of said lower edge.

3. A cup dispenser according to claim 1, wherein each of said portions is provided with an inwardly-directed lip.

4. A cup dispenser according to claim 1, wherein said members are arcuate in cross-section.

5. A cup dispenser according to claim 1, wherein said members are substantially diametrically opposed within said opening.

6. A cup dispenser according to claim 1, wherein a major part of each of said members is positioned within the same imaginary semi-annular co-planar segment of said opening.

7. A cup dispenser according to claim 1, wherein said members are flexible between positions enabling the engagement and dispensing of cups having rims with diameters of between 4.5 and 7.6 cm.

8. A cup dispenser for sequentially dispensing individual, disposable, rimmed cups having diameters varying from each other by several centimeters, from a stacked column thereof, comprising a cup-retaining and dispensing body provided with a tubular opening having a lower edge and with retaining means consisting essentially of at least two flexible flange members descending from an inner wall of said dispensing body, a first member of said members being subdivided into two portions and a second member of said members being subdivided into two portions wherein each of said portions is provided with an inwardly-directed lip, said first portion of said first member, in conjunction with the opposed first portion of said second member underlying and supporting the rim of a lowermost cup of said stacked column placed therein, and a second portion of said first member, in conjunction with the opposed second portion of said second member, simultaneously overriding the rim of said lowermost cup, and underriding and supporting the rim of the next to lowermost cup in said stacked column, whereby said pairs of first portions retain said lowermost cup until the removal thereof from said dispenser, while said pair of second portions of said opposed flexible flange members support and retain the next to lowermost cup during the removal of said lowermost cup from said dispenser.

9. A cup dispenser according to claim 8, wherein said opposed flexible flange members converge towards each other in the direction of said lower edge.

10. A cup dispenser according to claim 8, wherein a first portion of each of said members is of narrower width than a second portion of each of said members and extends from a central area of said second portion.

11. A cup dispenser according to claim 8, wherein said members are substantially arcuate in cross-section.

12. A cup dispenser according to claim 8, wherein said members are substantially opposed within said opening.

13. A cup dispenser according to claim 8, wherein a major part of each of said members is positioned within the same imaginary semi-annular co-planar segment of said opening.

14. A cup dispenser according to claim 8, wherein said members are flexible between positions enabling the engagement and dispensing of cups having rims with diameters of between 4.5 and 7.6 cm.

* * * * *